US005988908A

United States Patent [19]

Kageyama et al.

[11] Patent Number: 5,988,908

[45] **Date of Patent: *Nov. 23, 1999**

[54] BARREL WITH FINGER GRIPPING MEANS

[75] Inventors: Hidehei Kageyama; Yoshihide Mitsuya, both of Kawagoe, Japan

[73] Assignee: Kotobuki & Co., Ltd., Kyoto-hu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,903

[22] Filed: Dec. 23, 1996

[30] Foreign Application Priority Data

Dec. 26, 1995 [JP] Japan ..... 7-350725

[51] Int. Cl.[6] ..... B43K 23/008

[52] U.S. Cl. ..... 401/6; 401/88

[58] Field of Search ..... 401/6, 88; 15/443

[56] References Cited

U.S. PATENT DOCUMENTS

| | | | |
|---|---|---|---|
| H1050 | 5/1992 | Petrillo . | |
| 779,082 | 1/1905 | Huber | 401/6 X |
| 839,537 | 12/1906 | Beaumel | 15/443 |
| 4,911,569 | 3/1990 | Hashimoto et al. | 401/6 X |

FOREIGN PATENT DOCUMENTS

| | | | |
|---|---|---|---|
| 1236122 | 6/1960 | France | 401/6 |
| 3049467 | 7/1982 | Germany | 401/6 |
| 3404923 | 8/1985 | Germany | 401/6 |
| 2141295 | 5/1990 | Japan | 401/6 |

*Primary Examiner*—Steven A. Bratlie
*Attorney, Agent, or Firm*—Whitman, Curtis & Whitham

[57] ABSTRACT

A barrel for a implement adapted to be gripped by user's fingers in use, comprises a substantially cylindrical body having a finger gripping area and an outer circumferential recess portion provided around the finger gripping area, an elastic finger gripping member mounted the within the circumferential recess portion of the cylindrical body, the finger gripping member having a body of a substantially tubular shape, and a cooperating device for facilitating secure fitting of the finger gripping member within the recess portion of the cylindrical body.

8 Claims, 4 Drawing Sheets

BARREL WITH FINGER GRIPPING MEANS

BACKGROUND OF THE INVENTION

1. Field of the Invention

This invention relates to an improvement of a barrel with finger gripping means for an implement such as a mechanical pencil, a ball-point pen, a sign pen, a fountain pen, an eyeliner, an eyebrow pencil, a lipstick, an eraser dispenser, a marking pen, a solid adhesive dispenser for household, a plotter pen or the like. As one example of such implements, a ball-point pen will be referred to in the following.

2. Description of the Prior Art

Referring now to FIG. 1, a ball-point pen will be discussed in order to facilitate understanding of the present invention. The conventional ball-point pen includes a barrel 1 having a front barrel member 2 and a rear barrel member 3 threadedly connected to the front barrel member 2, and a writing medium (not shown) carried within the barrel 1. A head member 4 is threadedly attached to a front end of the front barrel member 2. The barrel 1 further has a circumferential recess portion 5 within which a finger gripping member 6 is mounted. The finger gripping member 6 is made of elastic material such as rubber, flexible plastic or the like and is formed into a substantially tubular-shape.

The finger gripping member 6 is made only by cutting a continuous tube material into a predetermined length. If there is an error in a length of the finger gripping member 6 and/or an error in dimensions of the recess portion 5 of the barrel 1, it is impossible to cause the finger gripping member 6 to be mounted with respect to the barrel body 1 in such a manner that the finger gripping member 6 is positively fitted within the recess portion 5. In addition, there are possibilities that the finger gripping member 6 will be displaced axially from the circumferential recess portion 5 of the barrel 1, will be turned up at an end portion of the finger gripping member 6, and will be turned relative to the barrel 1, during use of the ball-point pen. Further, even though there are no dimensional errors discussed above and the turning-up of the end portion of the finger gripping member 6 does not occur, any dust and/or dirt can easily enter a space between one end 6*a* of the finger gripping member 6 and one wall 5*a* of the circumferential recess portion 5, and a space between the other end 6*b* of the finger gripping member 6 and the other wall 5*b* of the circumferential recess portion 5, so that the conventional ball-point pen is bad from a sanitary standpoint.

SUMMARY OF THE INVENTION

It is therefore an object of this invention to provide a barrel with finger gripping means, in which the finger gripping means is securely fitted within a circumferential recess portion of the barrel.

It is another object of this invention to provide a barrel with finger gripping means, in which displacement of the finger gripping means relative to the barrel will be prevented.

It is still another object of the present invention to provide a barrel with finger gripping means, in which turning-up of an end of the finger gripping means will not occur.

It is yet another object of this invention to provide a barrel with finger gripping means, in which any dust and/or dirt will be prevented from entering spaces between both ends of the finger gripping means and both walls of a circumferential recess portion of the barrel.

In accordance with the present invention, there is provided a barrel for an implement having a finger gripping area to be gripped by a user's fingers when the implement is used. The barrel comprises a substantially cylindrical body having an outer circumferential recess portion provided around the finger gripping area thereof; finger gripping means mounted within the outer circumferential recess portion, the finger gripping means having a body of a substantially tubular-shape and first and second ends; and cooperating means on the cylindrical body and finger gripping means for facilitating secure fitting of the gripping means within the recess portion of the cylindrical body.

The cooperating means comprises an annular groove formed in one of opposite walls of the circumferential recess portion and extending in such a direction as to axially depart from the circumferential recess portion, and an annular projection projecting axially from one of the first and second ends of the finger gripping means. The finger gripping means is mounted within the recess portion with the annular projection thereof being fitted in the annular groove. The annular projection may be formed by causing an outer diameter of the one of the first and second ends of the finger gripping means to be reduced.

The cooperating means may comprise first and second annular grooves formed in the opposite walls of the circumferential recess portion and extending in such directions as to depart from the circumferential recess portion, and first and second annular projections projecting axially from the first and second ends of the finger gripping means. The finger gripping means is mounted within the circumferential recess portion with the first and second projections thereof being fitted in the first and second annular grooves.

The cooperating means may comprise an annular projection axially projecting into the recess portion from one of the opposite walls of the circumferential recess portion, and an annular groove formed in one of the first and second ends of the finger gripping means and extending axially. The finger gripping means is mounted within the circumferential recess portion with the annular groove thereof receiving the annular projection therein.

The cooperating means may comprise first and second annular projections axially projecting into the circumferential recess portion from the opposite walls of the circumferential recess portion, and first and second annular grooves formed in the first and second ends of the finger gripping means and extending axially. The finger gripping means is mounted within the circumferential recess portion with the first and second annular grooves thereof receiving the first and second annular projections therein.

The cooperating means may comprise at least one projection projecting radially from a region of a bottom surface of the circumferential recess portion, and a dent portion formed in a region of an inner surface portion of the finger gripping means, the dent portion corresponding in number to the at least one projection. The finger gripping means is mounted within the circumferential recess portion of the cylindrical body with the dent portion being engaged with the at least one projection.

The cooperating means may comprise at least one projection projecting radially inwardly from a region of an inner surface of the finger gripping means, and a dent portion formed in a region of a bottom surface portion of the circumferential recess portion of the cylindrical body, the dent portion corresponding in number to the at least one projection. The finger gripping means is mounted within the circumferential recess portion of the cylindrical body with the at least one projection thereof being engaged with the dent portion.

BRIEF DESCRIPTION OF THE DRAWINGS

The foregoing summary, as well as the following detailed description of the preferred embodiments of the present invention, will be better understood when read in conjunction with the appended drawings, in which.

DETAILED DESCRIPTION OF THE PREFERRED EMBODIMENTS

A barrel for a ball-point pen according to the present invention includes a substantially cylindrical body within which a writing medium of the type well known in the art is to be carried, the cylindrical body having an outer circumferential recess portion formed in at least a finger gripping area thereof, finger gripping means of a substantially tubular shape mounted within the circumferential recess portion, and cooperating means on the cylindrical body and finger gripping means for facilitating secure fitting of the finger gripping means within the recess portion of the cylindrical body.

Figure 1:
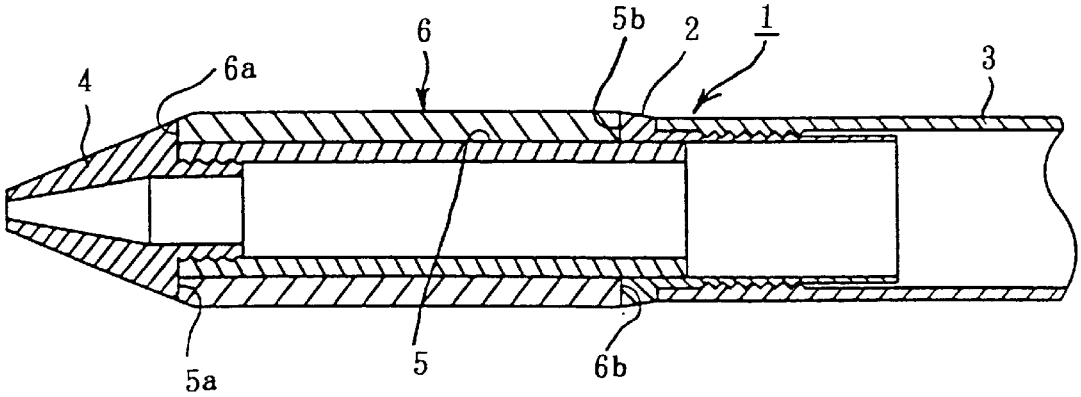
FIG. 1 PRIOR ART
FIG. 1 is a schematic longitudinal section view of a conventional barrel for a ball-point pen.
Figure 2:
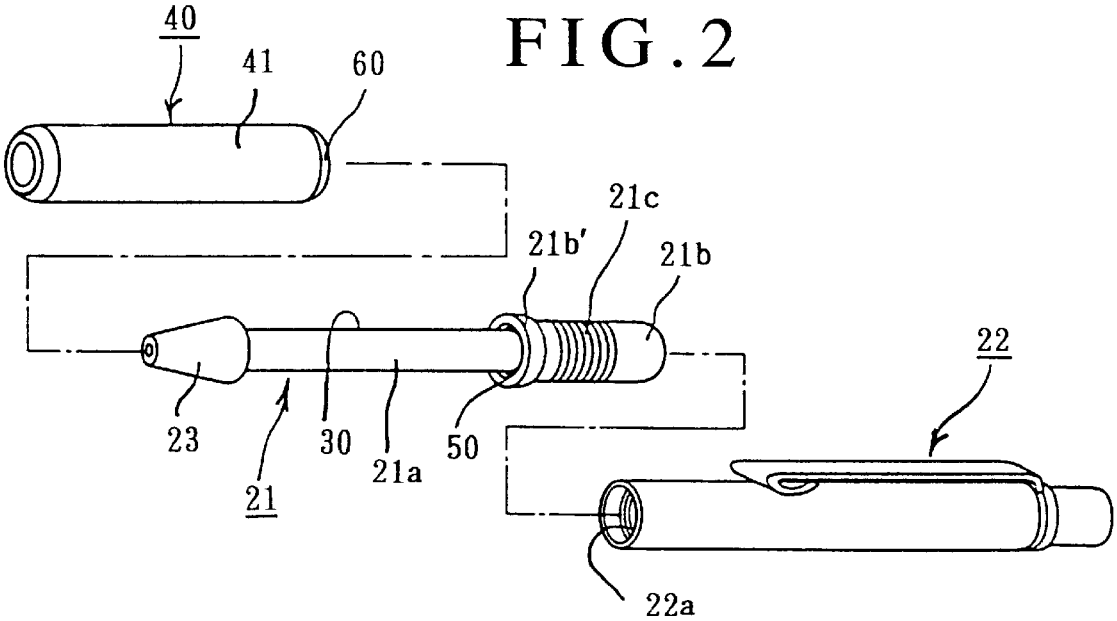
FIG. 2 is a schematic exploded perspective view of a barrel for a ball-point pen according to a first embodiment of the present invention.
Figure 3:
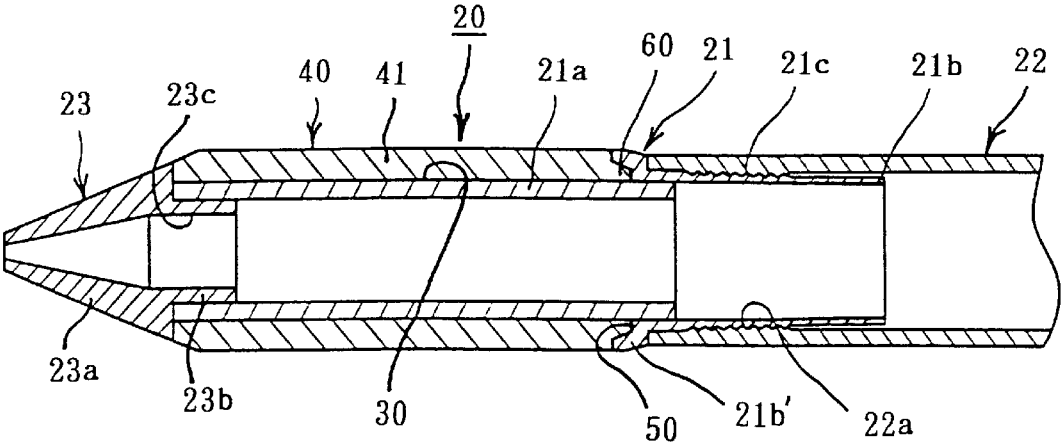
FIG. 3 is a schematic longitudinal section view of the barrel of FIG. 2.

Referring now to FIGS. 2 and 3, there is illustrated a barrel with finger gripping means according to a first embodiment of this invention. In this embodiment, a substantially cylindrical body 20 of the barrel includes a first barrel member 21 and a second barrel member 22. The first barrel member 21 includes a first section 21*a*, a second section 21*b* having an outer diameter larger than that of the first section 21*a* and extending axially from one end of the first section 21*a*, and a head member 23 attached to the other end of first section 21*a*. The second section 21*b* of the first barrel member 21 has an enlarged outer diameter-end 21*b*' and an externally threaded area 21*c* around an outer surface of a region thereof. The second barrel member 22 has an internally threaded area 22*a* around an inner surface of a region thereof. The first barrel member 21 and second barrel member 22 are threadedly connected to each other through the externally threaded area 21*c* of the first barrel member 21 and the internally threaded area 22*a* of the second barrel member 22. The head member 23 includes a body 23*a* of a substantially cone-shape, a stem 23*b* of a small diameter axially extending from an enlarged diameter-end of the cone-shaped body 23*a*, and a passageway 23*c* penetrating through the substantially cone-shaped body 23*a* and stem 23*b* for allowing a writing tip of a writing medium (not shown) to pass therethrough. The head member 23 is attached to the other end of the first section 21*a* of the first barrel member 21 by causing the stem 23*b* to be press-fitted in the first section 21*a* of the first barrel member 21, whereby a circumferential recess portion 30 is provided between the enlarged diameter-end of the cone-shaped body 23*a* of the head member 23 and the enlarged outer diameter-end 21*b*' of the second section 21*b*of the first barrel member 21 and around the first section 21*a* of the first barrel member 21. Finger gripping means 40 is mounted within the circumferential recess portion 30 of the cylindrical body 20. The finger gripping means 40 is made of elastic material such as rubber, flexible plastic material or the like and has a body 41 of a substantially tubular shape. The tubular body 41 of the finger gripping means 40 has first and second ends.

The cooperating means on the cylindrical body 20 and finger gripping means 40 for facilitating secure fitting of the finger gripping means 40 within the circumferential recess portion 30 of the cylindrical body 20 comprises an annular groove 50 formed in one of opposite walls of the circumferential recess portion 30 and extending in such a direction as to axially depart from the recess portion 30, and an annular projection 60 projecting axially from one of the first and second ends of the finger gripping means 40 which is opposed to the wall of the recess portion 30, in which the annular groove 50 is formed, when the finger gripping means 40 is mounted in the recess portion 30 of the cylindrical body 20 for assembly. In the illustrated embodiment, the annular groove 50 of the cooperating means is formed in the end 21*b*' of the second section 21*b* of the first barrel member 21 which constitutes one of the both walls of the recess portion 30. The projection 60 of the cooperating means may be formed by causing an outer diameter of the one of the first and second ends of the finger gripping means 40 to be reduced. The finger gripping means 40 is mounted within the circumferential recess portion 30 of the cylindrical body 20 with the projection 60 thereof being fitted in the annular groove 50 of the second section 21*b* of the first barrel member 21. In this condition, the projection 60 of the finger gripping means 40 is surrounded by a wall of the annular groove 50, so that the finger gripping means 40 can be effectively fitted and retained within the recess portion 30 of the cylindrical body 20. Further, the projection 60 of the finger gripping means 40 is fitted in the annular groove 50 of the second section 21*b* of the first barrel member 21, so that axial movement of the finger gripping means 40 relative to the cylindrical body 20 can be effectively prevented. Also, rotational movement of the finger gripping means 40 relative to the cylindrical body 20 can be effectively prevented, because the finger gripping means 40 is held radially inwardly at the projection 60 thereof by the wall of the annularly grooved portion 50 of the cylindrical body 20, whereby frictional resistance will be produced between the projection 60 of the finger gripping means 40 and the annularly grooved portion 50 of the cylindrical body 20. In addition, turning-up of the first end of the finger gripping means 40 at which the projection 60 is provided can be positively prevented, because the annular projection 60 is securely fitted in the annular groove 50.

Figure 7:
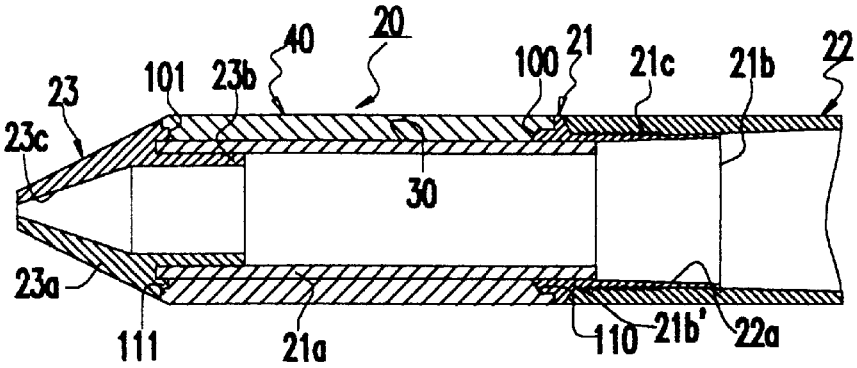
FIG. 7 is a schematic longitudinal section view of a barrel for a ball-point pen having annular grooves and projections in opposite directions than shown in FIG. 4.

In an alternate embodiment shown in FIG. 7, annular projections 100, 101 project into the recess portion from opposite walls of the circumferential recess 30. Annular grooves 110,111 formed in the ends of the finger gripping means 40 receive annular projections 100,101.

Assembling of the barrel according to the first embodiment is performed in such a manner as will be discussed hereinafter. The cylindrical body 20 is assembled by causing the second barrel member 22 to be threadedly connected to the first barrel member 21 to which the head member 23 is previously attached. Then, the finger gripping means 40 is mounted with respect to the cylindrical body 20 by causing the finger gripping means 40 to be axially moved along and relative to the cylindrical body 20 while causing the finger gripping means 40 to be press-fitted on the cone-shaped body 23*a* of the head member 23, and causing the annular projection 60 of the finger gripping means 40 to be received in the annular groove 50 of the second section 21*b* of the first barrel member 21. If any suitable lubricant is previously applied onto an outer surface of the cone-shaped body 23*a* of the head member 23, the mounting operation of the finger gripping means 40 with respect to the cylindrical body 20 can be easily performed while causing the finger gripping means to be slid on the lubricant-applied surface of the cone-shaped body 23*a*.

Incidentally, the finger gripping means 40 is made of elastic material such as rubber, flexible plastic material or the like as described above. Therefore, even if the finger gripping means 40 is excessively thrust in the direction in which the finger gripping means 40 is moved relative to the cylindrical body 20 during mounting of the finger gripping means 40, and the second end of the finger gripping means 40 goes over a boundary between the head member 23 and the first barrel member 21 and departs from the boundary, the finger gripping means 40 restores to its original state due to an inherent elasticity thereof. As a result, the second end of the finger gripping means 40 is abutted against the end of the cone-shaped body 23*a* of the head member 23. Thus, the finger gripping means 40 can be securely positioned within the recess portion 30 of the cylindrical body 20.

In the first embodiment, the annular groove 50 of the cooperating means is formed in the one of the both walls of the circumferential recess portion 30. The annular projection 60 of the cooperating means is provided at the one of the first and second ends of the finger gripping means 40. Alternatively, the annular projection of the cooperating means may be provided at one of the two walls of the circumferential recess portion 30 in a manner to axially project in the recess portion 30 from the one of the two walls of the recess portion 30. In this regard, the annular groove of the cooperating means may be formed in one of the first and second ends of the finger gripping means 40 which is opposed to the wall of the recess portion 30, from which the annular projection projects, when the finger gripping means 40 is mounted within the recess portion 30 of the cylindrical body 20 for assembly.

Figure 4:
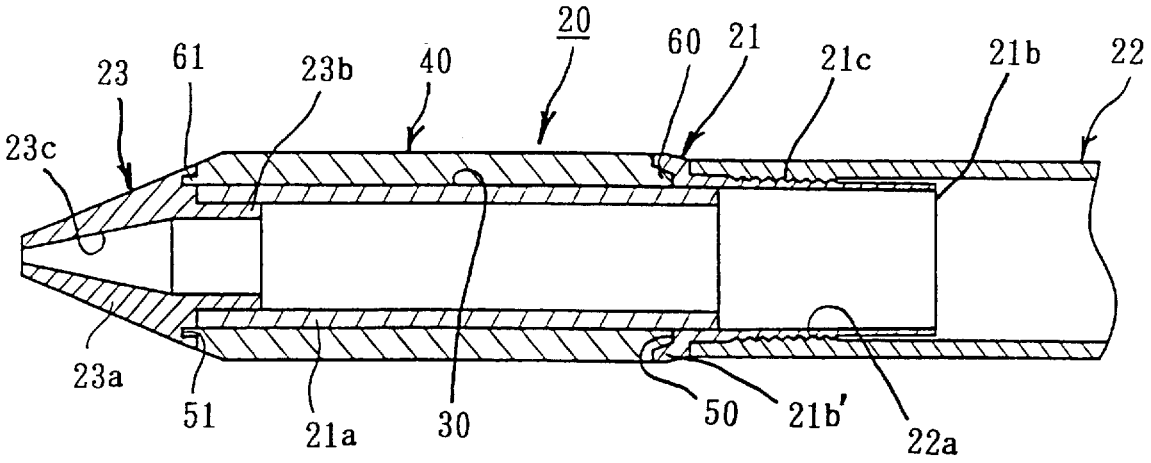
FIG. 4 is a schematic longitudinal section view of a barrel for a ball-point pen according to a second embodiment of the present invention.

Referring to FIG. 4, there is illustrated a barrel for a ball-point pen according to a second embodiment of the present invention. The embodiment of FIG. 4 is substantially similar to the first embodiment of FIGS. 2 and 3 except that the cooperating means further includes a second annular projection 61 provided at the second end of the finger gripping means 40, and a second annular groove 51 formed in the end of the cone-shaped body 23*a* of the head member 23 which constitutes the other of the both walls of the recess portion 30. The second annular groove 51 axially extends in such a direction as to depart from the recess portion 30. In this regard, the second projection 61 axially projects from the second end of the finger gripping means 40. In the second embodiment of FIG. 4, parts which are substantially similar to those shown in FIGS. 2 and 3 are denoted with like reference numerals and the description of them will not be repeated.

In the second embodiment of FIG. 4, the cooperating means comprises the first and second annular projections 60, 61 provided at the first and second ends of the finger gripping means 40, and the first and second annular grooves 50, 51 formed in the both walls of the recess portion 30 of the cylindrical body 20. The first and second annular projections 60, 61 of the finger gripping means 40 are received in the annular grooves 50, 51, respectively. Therefore, the finger gripping means 40 of this embodiment can be further securely retained within the recess portion 30 of the cylindrical body 20.

As described above, the cooperating means of the second embodiment comprises the first and second annular projections 60, 61 provided at the first and second ends of the finger gripping means 40, and the first and second annular grooves 50, 51 formed in the both walls of the recess portion 30 of the cylindrical body 20. Alternatively, there may be employed cooperating means comprising first and second annular projections axially projecting into the circumferential recess portion from the both walls of the circumferential recess portion, and first and second annular grooves formed in the first and second ends of the finger gripping means and extending axially.

Figure 5A:
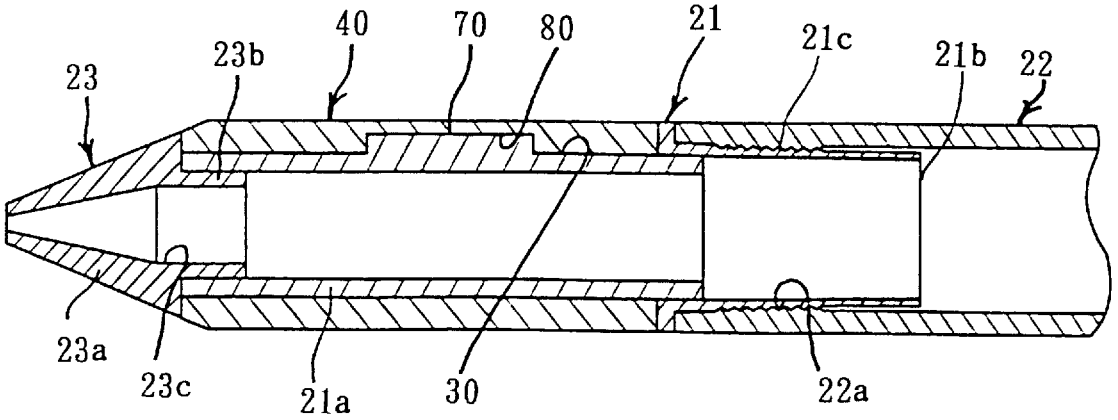
FIG. 5A is a schematic longitudinal section view of a barrel for a ball-point pen according to a third embodiment of the present invention.
Figure 5B:
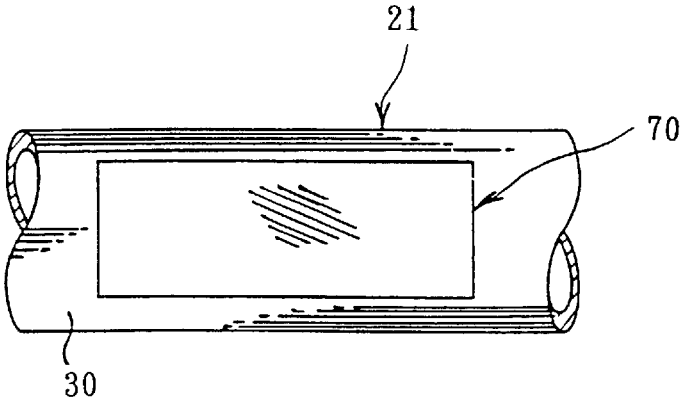
FIG. 5B is a schematic enlarged segmentary plan view of a first barrel member of the barrel illustrated in FIG. 5A.

Referring to FIGS. 5A and 5B, there is illustrated a barrel for a ball-point pen according to a third embodiment of this invention. This embodiment is substantially similar to that of FIGS. 2–4 except that different cooperating means is employed. In the third embodiment of FIGS. 5A and 5B, components which are substantially similar to those shown in FIGS. 2–4 are designated with like reference numerals and the description of them will not be repeated.

The cooperating means of the third embodiment comprises at least one projection 70 projecting radially from a bottom surface of the recess portion 30 of the cylindrical body 20, and at least one dent portion 80 formed in an inner surface of the finger gripping means 40. The projection 70 of the cooperating means corresponds in number to the dent portion 80 of the cooperating means. In this embodiment, the finger gripping means 40 is mounted within the circumferential recess portion 30 of the cylindrical body 20 with the dent portion 80 thereof being engaged with the projection 70 of the cylindrical body 20, so that rotational movement of the finger gripping means 40 relative to the cylindrical body 20 can be securely prevented.

Figure 6:
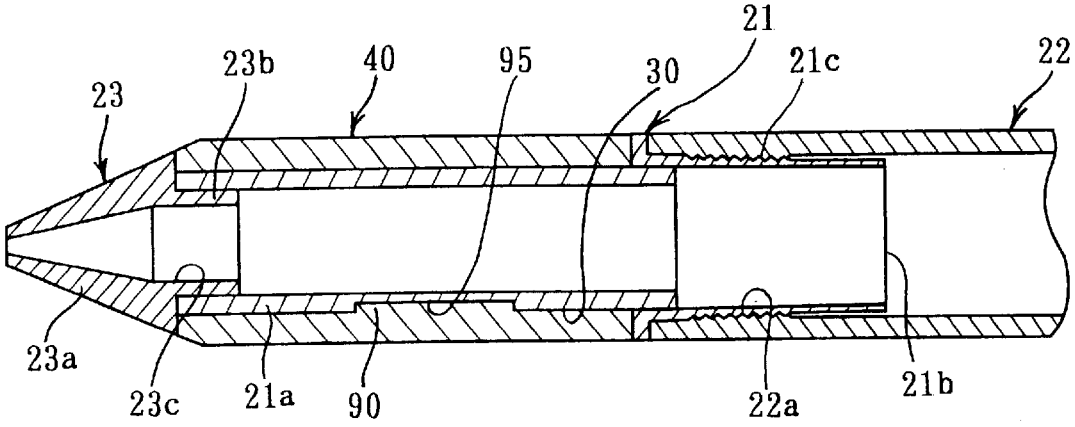
FIG. 6 is a schematic longitudinal section view of a modification of the barrel of FIGS. 5A and 5B.
Figure 8:
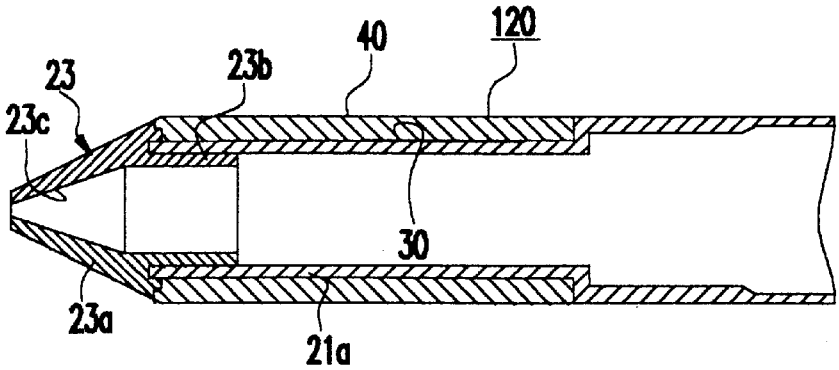
FIG. 8 is a schematic longitudinal section view of a barrel for a ball-point pen having the body formed as one piece.
Figure 9:
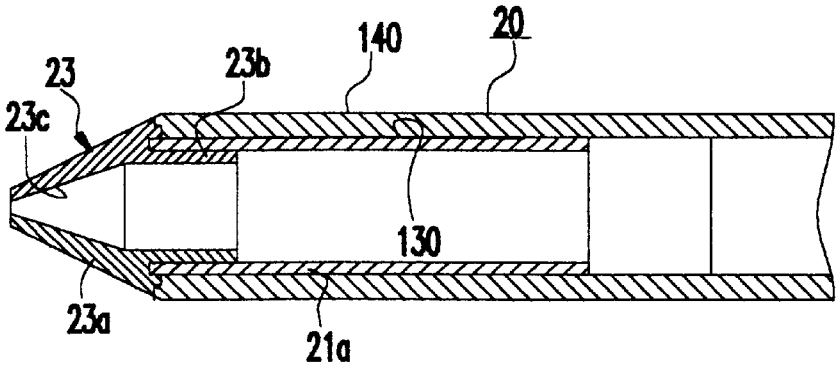
FIG. 9 is a schematic longitudinal section view of a barrel for a ball-point pen in which a circumferential recess extends for the length of the body.

As shown in FIG. 6, the cooperating means of the third embodiment may comprise at least one projection 90 projecting radially inwardly from a region of an inner surface of the finger gripping means 40, and a dent portion 95 formed in a region of the bottom surface portion of the circumferential recess portion 30 of the cylindrical body 20. In this case, the finger gripping means 40 is mounted within the circumferential recess portion 30 with the at least one projection 90 thereof being engaged with the dent portion 95. Also, The barrel according to the third embodiment may include the cooperating means of FIGS. 2 and 3 as well as the cooperating means of FIGS. 5A and 5B or the cooperating means of FIG 6. Alternatively, the barrel according to the third embodiment may include the cooperating means of Further embodiments are shown in FIGS. 8 and 9. FIG. 8 demonstrates the inventive barrel as having a one-piece body 120 with the finger gripping means 40 positioned thereon. FIG. 9 shows the barrel having a finger gripping means 140 which extends the length of the body, having a circumferential recess portion 130 FIG. 4 as well as the cooperating means of FIGS. 5A and 5B.

In the above embodiments, the cylindrical body 20 is assembled by causing the second barrel member 22 to be threadedly connected to the first barrel 21 to which the head member 23 is previously attached. However, the cylindrical body 20 may be formed as a one-piece member having the first and second barrel members 21, 22 and the head member 23. While the barrel for a ball-point pen is referred to in the foregoing, the barrel according to the present invention can be employed as a barrel for an implement such as a mechanical pencil, a ball-point pen, a sign pen, a fountain pen, an eyeliner, an eyebrow pencil, a lipstick, an eraser dispenser, a marking pen, a solid adhesive dispenser for household, a plotter pen or the like. Also, while the outer circumferential recess portion 30 is provided around the finger gripping area of the cylindrical body 20 and the finger gripping means 40 which has a length substantially corresponding to that of the recess portion 30 is mounted within the recess portion 30 of the cylindrical body 20, the circumferential recess portion may be provided around the total length of the cylindrical body 20 including a finger gripping area as indicated by the portion thereof shown in FIG. 5B of the cylindrical body 20 and finger gripping means which has a length substantially coresponding to that of the recess portion may be mounted within the recess portion.

The terms and expressions which have been employed are used as terms of description and not of limitation, and there is no intention in the use of such terms and expression of excluding any equivalents of the features shown and described, or portions thereof, but it is recognized that various modifications are possible within the scope of the invention claimed.

What is claimed is:

1. A barrel for an implement adapted to be gripped by user's fingers in use, said barrel comprising:

a substantially cylindrical body having a finger gripping area and an outer circumferential recess portion provided around at least said finger gripping area;

finger gripping means mounted within said circumferential recess portion of said cylindrical body, said finger gripping means having an inner surface contacting with a surface of said circumferential recess portion;

said finger gripping means made of elastic material and having a solid body of a substantially tubular shape, and first and second ends, said finger gripping means having a same outer circumference over the finger gripping area; and cooperating means on said cylindrical body and finger gripping means for securely fitting of said finger gripping means within said circumferential recess portion of said cylindrical body in order to prevent movement of the gripping means, said cooperating means comprising:

a groove formed in at least one of opposite walls of said circumferential recess portion and extending axially with respect to said circumferential recess portion;

a projection axially projecting from at least one of said first and second ends of said finger gripping means; and said finger gripping means mounted within said circumferential recess portion with said projection being fitted in said groove formed in the at least one of said opposite walls of said circumferential recess portion of said cylindrical body.

2. A barrel as defined in claim 1, wherein said cylindrical body comprises:

a first barrel member having first and second ends, a second barrel member connected at one end to said first end of said first barrel member, and a head member connected to said second end of said first barrel member.

3. A barrel as defined in claim 2, wherein said cylindrical body is formed as a one-piece member having said first and second barrel members and said head member.

4. A barrel as defined in claim 1, wherein:

said circumferential recess portion is provided around an entire length of said cylindrical body including said finger gripping area of said cylindrical body, and said finger gripping means has a length substantially corresponding to the length of said circumferential recess portion.

5. A barrel for an implement adapted to be gripped by user's fingers in use, said barrel comprising:

a substantially cylindrical body having a finger gripping area and an outer circumferential recess portion provided around at least said finger gripping area;

finger gripping means mounted within said circumferential recess portion of said cylindrical body, said finger gripping means having an inner surface contacting with a surface of said circumferential recess portion;

said finger gripping means made of elastic material and having a solid body of a substantially tubular shape and first and second ends, said finger gripping means having a same outer circumference over the finger gripping area; and cooperating means on said cylindrical body and finger gripping means for securely fitting said finger gripping means within said circumferential recess portion of said cylindrical body in order to prevent movement of the gripping means;

said cooperating means comprising:

a projection axially projecting into said circumferential recess portion from at least one of opposite walls of said circumferential recess portion;

a groove formed in at least one of said first and second ends of said finger gripping means and extending axially; and said finger gripping means mounted within said circumferential recess portion with said groove receiving said projection therein.

6. A barrel as defined in claim 5, wherein said cylindrical body comprises:

a first barrel member having first and second ends, a second barrel member connected at one end thereof to said first end of said first barrel member, and a head member connected to said second end of said first barrel member.

7. A barrel as defined in claim 6, wherein said cylindrical body is formed as a one-piece member having said first and second barrel members and said head member.

8. A barrel as defined in claim 5, wherein said circumferential recess portion is provided around the total length of said cylindrical body including said finger gripping area of said cylindrical body, and said finger gripping means has a length substantially corresponding to that of said circumferential recess portion.

* * * * *